US008091818B2

(12) United States Patent
Stemper

(10) Patent No.: US 8,091,818 B2
(45) **Date of Patent: *Jan. 10, 2012**

(54) GYRATORY CONE CRUSHER WITH SKEWED NON-CO-PLANAR CONEHEAD AND MAIN CRUSHER CENTERLINES

(75) Inventor: Michael P. Stemper, Marion, IA (US)

(73) Assignee: Terex USA, LLC, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/880,979

(22) Filed: Sep. 13, 2010

(65) Prior Publication Data

US 2011/0000994 A1 Jan. 6, 2011

Related U.S. Application Data

(63) Continuation of application No. 11/689,905, filed on Mar. 22, 2007, now Pat. No. 7,810,749.

(60) Provisional application No. 60/862,863, filed on Oct. 25, 2006.

(51) Int. Cl.
*B02C 25/00* (2006.01)

(52) U.S. Cl. ..... 241/207; 241/208

(58) Field of Classification Search ..... 241/207–217
See application file for complete search history.

(56) References Cited

U.S. PATENT DOCUMENTS

| | | | | | |
|---|---|---|---|---|---|
| 2,014,588 | A | * | 9/1935 | Rumpel | 403/267 |
| 4,679,741 | A | * | 7/1987 | Hansen | 241/206 |
| 5,115,991 | A | * | 5/1992 | Saari | 241/208 |
| 5,350,125 | A | * | 9/1994 | Clark | 241/208 |
| 5,732,896 | A | * | 3/1998 | Jakob et al. | 241/215 |
| 5,803,382 | A | * | 9/1998 | Ganser et al. | 241/214 |
| 5,806,772 | A | * | 9/1998 | Karra | 241/57 |
| 5,810,268 | A | * | 9/1998 | Ganser et al. | 241/207 |
| 5,927,623 | A | * | 7/1999 | Ferguson et al. | 241/36 |
| 5,931,394 | A | * | 8/1999 | Haven et al. | 241/30 |
| 5,996,916 | A | * | 12/1999 | Musil | 241/215 |

* cited by examiner

*Primary Examiner* — Faye Francis
(74) *Attorney, Agent, or Firm* — Simmons Perrine Moyer Bergman PLC

(57) ABSTRACT

A gyratory cone crusher with a conehead centerline and a main centerline being skewed and non-coplanar with respect to each other. The conehead exhibits an elliptical movement path which results in faster throughput and enhanced cubicity performance.

17 Claims, 2 Drawing Sheets

GYRATORY CONE CRUSHER WITH SKEWED NON-CO-PLANAR CONEHEAD AND MAIN CRUSHER CENTERLINES

CROSS-REFERENCE TO RELATED APPLICATIONS

This application claims the benefit of provisional Application No. 60/862,863 filed on Oct. 25, 2006, and the patent application Ser. No. 11/689,905 filed, now U.S. Pat. No. 7,810,749 Mar. 22, 2007 by Michael P. Stemper.

BACKGROUND OF THE INVENTION

The present invention relates to gyratory cone-style crushers.

Gyratory cone-style crushers typically have a crusher conehead which has a generally cone-shaped outer surface which is mounted to undergo gyratory motion. The conehead is generally centered about a conehead centerline axis that is angularly offset from a vertical axis generally centered through the crusher.

Gyratory crushers also typically have a bowl-shaped member or concave or bonnet disposed in an inverted stationary position generally over the conehead and centered about the vertical main centerline crusher axis.

The conehead centerline is defined by an eccentric which is driven about the main centerline.

In U.S. Pat. No. 5,996,916 to Musil, the eccentric defines a conehead centerline which is co-planar, but not parallel, with the main centerline.

While the various prior art gyratory cone-style crushers have been used extensively for many years, they do have some drawbacks. One problem with prior art cone-style crushers is that processing material through the crusher can be time consuming and obtaining a desired cubicity often involves undesirable tradeoffs.

Consequently, there exists a need for improved methods and systems for quickly crushing rock with a desired cubicity characteristic.

SUMMARY OF THE INVENTION

It is an object of the present invention to provide a system and method for crushing rock in an efficient manner.

It is a feature of the present invention to utilize a cone-style crusher with a cone centerline axis and a main crusher centerline axis being skewed and non-co-planar.

It is an advantage of the present invention to increase the material throughput rate in a cone-style crusher.

It is another advantage to provide for increased cubicity performance and ease of and range of control of cubicity in material output from a cone-style crusher.

The present invention is an apparatus and method for crushing rock which is designed to satisfy the aforementioned needs, provide the previously stated objects, include the above-listed features, and achieve the already articulated advantages.

Accordingly, the present invention is a system and method where the conehead centerline and the main crusher centerline are skewed and non-coplanar.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
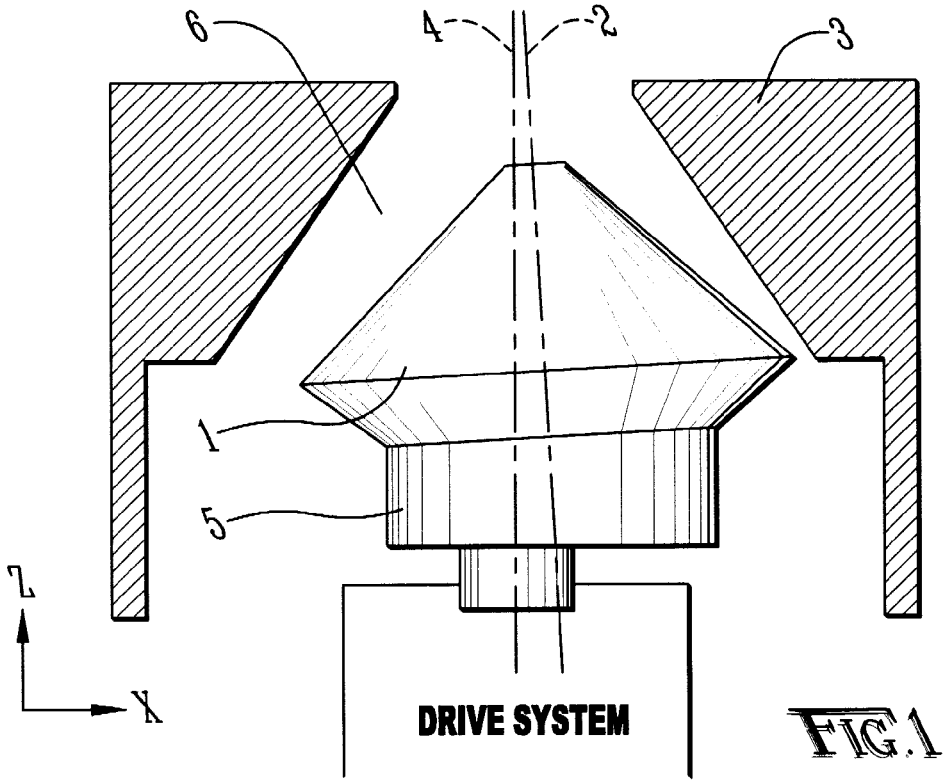
FIG. 1 is view of a system of the present invention.

Now referring to the drawings wherein like numerals refer to like matter throughout, and more specifically referring to FIG. 1, there is shown a side elevation view of a system of the present invention. The axes z and x are labeled. The conehead 1 is shown disposed with a conehead centerline 2 and under a bowl 3 so as to be closer to the right side of the bowl 3. Conehead 1 rotates freely about the conehead centerline 2. In such a configuration, the crushing chamber 6 is smaller, at this instant, on the right than it is on the left. Main centerline 4 is shown centrally disposed in the bowl 3. The eccentric 5 defines the conehead centerline 2 and is shown supporting the conehead 1. When the eccentric 5 is driven around the main centerline 4, the novel operation of the present invention occurs. The conehead 1 wobbles within the bowl 3. The nature of this wobble is significant.

Figure 2:
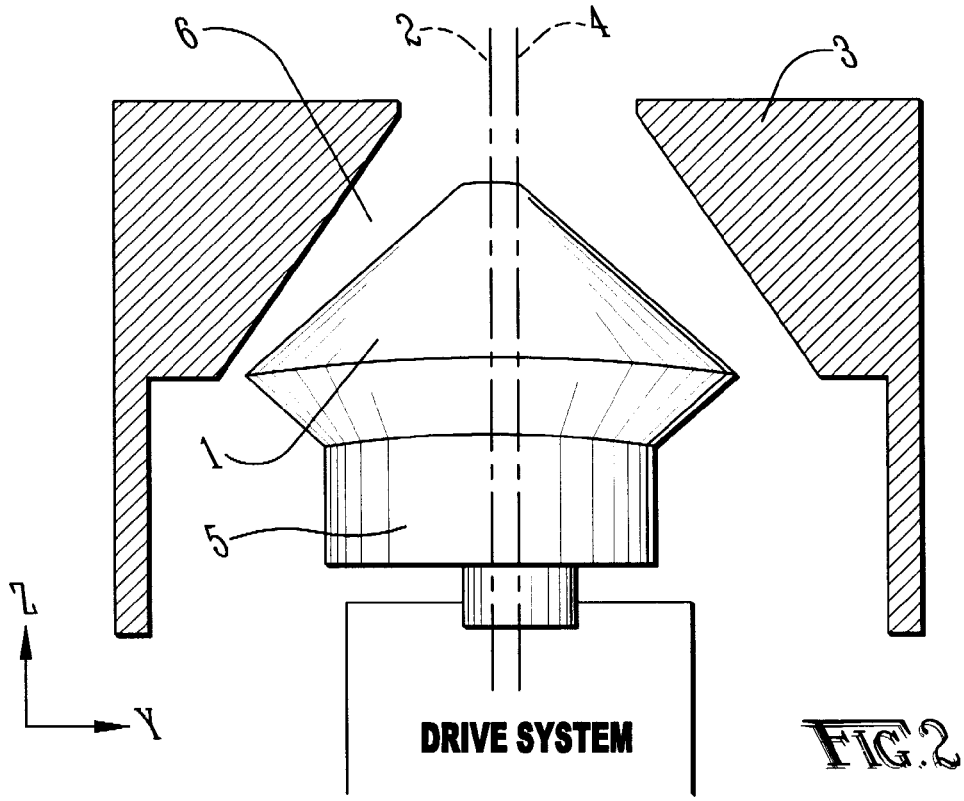
FIG. 2 is a view of the system of FIG. 1 taken at a 90-degree angle from FIG. 1.

In FIG. 2, the system is shown from an angle 90 degrees off FIG. 1.

A key aspect of the present invention is that the conehead centerline 2 and the main centerline 4 are skewed with respect to each other and are not co-planar; i.e. conehead centerline 2 and main centerline 4 are not parallel, and they are not intersecting. The amount conehead centerline 2 is skewed from main centerline 4 is a matter of design choice; however, it must be a substantial amount to produce the desired effects. A minimum separation between conehead centerline 2 and main centerline 4 of about ¼ of an inch is expected to yield the desired results. A minimum separation of about $1/32^{nd}$ of an inch or smaller is believed to be too small to provide significant benefits. Consequently, prior art systems which were designed for no skewing of the conehead centerline 2 and the main centerline 4 would with manufacturing tolerances expect to be within $1/32^{nd}$ of an inch.

Figure 3:
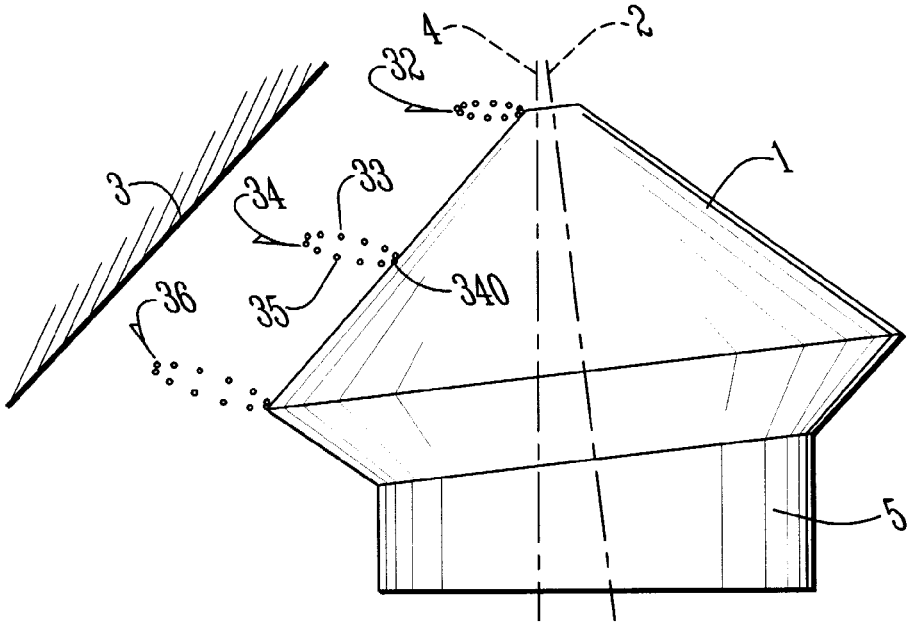
FIG. 3 is a view of a conehead of the present invention where each of the series of open circles shows an elliptical path of a point (solid circles or dots) on the surface of the conehead when the system is operated.

Now referring to FIG. 3, there is shown the conehead 1 of FIG. 1, together with three series of dots, 32, 34 and 36. As the eccentric 5 is driven one complete revolution about the main centerline 4, each series of dots represents a path of a particular point on the conehead 1, and each dot represents a position in time of that specific point, which is shown by a solid dot on the surface of conehead 1. Because of the skewed and non-coplanar relationship between the conehead centerline 2 and the main centerline 4, the paths are elliptical in shape. Prior art coneheads would typically follow a linear path as the eccentric revolves. The series 34 is shown having a high path portion 33 which is above the low path portion 35.

The point 340 may first move toward the bowl 3 either upward along high path portion 33 or, if the eccentric 5 is revolved in the opposite direction, along the low path portion 35. If the conehead 1 first approaches the closed side setting or closest point to the bowl 3 along the high path portion 33, then there will be a downward component of the force when the conehead 1 reaches the closed point. This downward force can help to propel the material through the crusher and thereby speed up material throughput. If the eccentric 5 revolves around the main centerline 4 in an opposite direction, then the point 340 will first approach the bowl 3 along low path portion 35. At the closest point to the bowl 3, point 340 will then have an upward movement which can impart a retarding force upward. Additionally, in either direction of rotation of eccentric 5, there is movement vector component at least in part parallel to the surface of bowl 3. This component of the movement vector results in material having a higher cubicity as opposed to coneheads which merely follow a linear path to and from the closest point.

Figure 4:
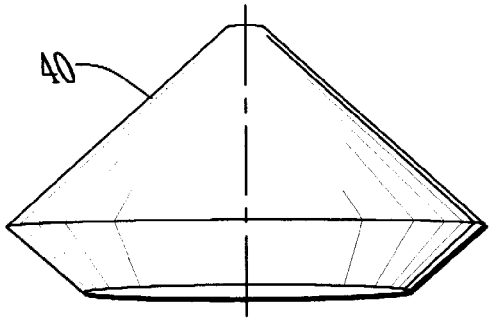
FIG. 4 is a view of a prior art conehead with the closed side nearest the viewer.

Now referring to FIG. 4, there is shown a prior art coplanar main centerline and conehead line. The conehead 40 in FIG. 4 is shown with the closed side nearest the viewer. The centerline in FIG. 4 is the main centerline. The closed side of the crushing chamber is also coplanar to the main centerline.

Figure 5:
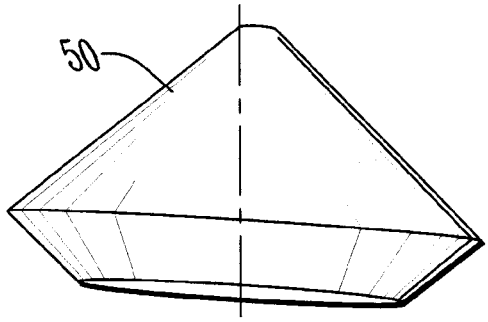
FIG. 5 is a view of the present invention with closed side nearest the viewer.

Now referring to FIG. 5, there is shown a conehead 50 with a skewed main centerline and conehead centerline. The conehead 50 is also shown with the closed side nearest the viewer. The centerline shown in FIG. 5 is the main centerline. The closed side of the crushing chamber will, because of the skew, be non-coplanar with the main centerline. Because of the skew, the speed at which material passes through the crusher and the number of times the material is subjected to closed side crushing will be different, depending upon the amount of the skew between the conehead centerline 2 and the main centerline 4.

In one embodiment of the present invention, the eccentric 5 could be one of several different eccentrics where each is interchangeable, but having a different orientation or amount of skew (i.e. minimum separation distance between conehead centerline 2 and main centerline 4). The different eccentrics and the conehead 1 and the drive systems could all be designed to provide for rapid extraction and insertion of different eccentrics.

Throughout this description, rock is referred to as the material being crushed. It is well understood that other materials, such as concrete, may be crushed in a cone-style crusher.

Throughout this description, details of how a cone-style crusher works have been omitted because they are well known in the art. U.S. Pat. No. 5,996,916 to Musil could be, with the benefit of the teachings of this innovation, readily adapted to carry out the present invention by creating an eccentric which results in the skewed and non-coplanar relationships which are key to the present invention. Additionally, such patent could be adapted to have an interchangeable eccentric so as to provide for flexibility in performance without undue investment in hardware and time to make changes.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

I claim:

1. A gyratory cone crusher comprising:

a cavity having a main centerline;

a substantially cone shaped member generally disposed inside of said cavity, said substantially cone shaped member being configured to rotate around a conehead centerline;

an eccentric configured to revolve around the main centerline, the eccentric further configured to limit a range of possible orientations of the conehead centerline as the eccentric revolves around the main centerline;

the main centerline and the conehead centerline being non-coplanar; and a drive system configured to rotate the substantially cone shaped member about the conehead centerline and simultaneously drive the eccentric around the main centerline such that such conehead is caused to move alternately from a closed side to an open side and thereby crush material passing between the moving substantially cone shaped member and the cavity at the closed side.

2. The gyratory cone crusher of claim 1 wherein the substantially cone shaped member follows an elliptical path as the eccentric revolves around the main centerline.

3. The gyratory cone crusher of claim 2 wherein the elliptical path creates a force upon a rock disposed on the substantially cone shaped member, such that the force has a variable vertical component so that the force applied by the conehead to a rock thereon is directed first in an upwardly direction when beginning an approach to the closed side and subsequently reducing an upward component of the force when finishing an approach to the closed side, thereby allowing material passing through the closed side.

4. The gyratory cone crusher of claim 1 wherein a minimum separation distance between the conehead centerline and the main centerline is ¼ of an inch.

5. The gyratory cone crusher of claim 1 wherein the minimum separation distance is ½ inch.

6. The gyratory cone crusher of claim 1 wherein the main centerline is vertical and the bowl is symmetrically disposed about the main centerline.

7. The gyratory cone crusher of claim 1 wherein the eccentric is chosen from a plurality of interchangeable eccentrics, each defining a different minimum separation distance between the conehead centerline and the main centerline.

8. The gyratory cone crusher of claim 1 wherein the bowl is vertically adjustable along the main centerline so as to adjust a closed side setting, thereby adjusting a size characteristic of material passing past the conehead.

9. The gyratory cone crusher of claim 1 wherein the drive system is configured to drive the eccentric in either of two opposite directions and at variable speeds in each of said two opposite directions.

10. An apparatus for crushing rock comprising:

a rigid structural member having a substantially triangular cross section with an apex and a broader base region, comprising an exterior conehead crushing surface and a conehead centerline;

means for moving the conehead centerline about a main centerline;

means for resisting movement of a material being pushed by said exterior conehead crushing surface, which means for resisting movement is substantially symmetrical about the main centerline and has an interior surface;

said means for moving the conehead, configured so that when moving in a first manner, through at least two complete iteractions, the conehead centerline and the main centerline continuously do not intersect and continuously are not parallel with respect to each other;

the conehead rigid structural member configured for moving about the conehead centerline; and said means for resisting further comprising an orifice therein for accepting material to fall, through said means for resisting movement, and allowing material to be located between the rigid structural member and the inside surface and become crushed when the conehead moves toward the inside surface.

11. The cone crusher of claim 10 wherein the means for moving the conehead centerline comprises an eccentric.

12. The cone crusher of claim 11 wherein said means for resisting movement of material is an inverted bowl disposed over the rigid structural member.

13. The cone crusher of claim 12 wherein the orifice in said means for resisting comprises an opening in said bowl substantially symmetrically disposed about said main centerline.

14. The cone crusher of claim 13 wherein a minimum separation distance of said conehead centerline and said main centerline is ½ inch.

15. A cone crusher comprising:

a rock receiving cavity comprising an inside crushing surface against which rocks can be crushed, said substantially cone shaped member having a main centerline;

a member with a conehead centerline, about which said member rotates;

a drive system;

an eccentric coupled between said member and said drive system, said eccentric restrictive orientations of said member centerline, said eccentric further configured to be driven around the main centerline, so as to support said member and cause said member to wobble within said rock receiving cavity; and said main centerline and said conehead centerline being continuously substantially skewed with respect to each other and are continuously not substantially co-planar and non-intersecting.

16. The cone crusher of claim 15 wherein said main centerline and said conehead centerline having a minimum separation distance of between 1/32 of an inch and ¼ of an inch.

17. The cone crusher of claim 15 wherein said main centerline and said conehead centerline having a minimum separation distance ¼ of an inch.

* * * * *